United States Patent [19]

Matsuzaka

[11] Patent Number: 4,992,835

[45] Date of Patent: Feb. 12, 1991

[54] ELECTROPHOTOGRAPHIC IMAGE FORMING APPARATUS

[75] Inventor: Hideki Matsuzaka, Yokohama, Japan

[73] Assignee: Ricoh Company, Ltd., Tokyo, Japan

[21] Appl. No.: 533,288

[22] Filed: Jun. 5, 1990

[30] Foreign Application Priority Data

Jun. 12, 1989 [JP] Japan ..... 64-148583

[51] Int. Cl.[5] ..... G03G 21/00

[52] U.S. Cl. ..... 355/312; 271/310; 355/315

[58] Field of Search ..... 355/312, 210, 200, 308, 355/309, 321, 315; 269/20, 21, 30; 271/310

[56] References Cited

U.S. PATENT DOCUMENTS 3,826,568 7/1974 Hudson ..... 355/312 X
3,867,026 2/1975 Ogawa ..... 355/312 X
4,702,587 10/1987 Miyoshi ..... 355/200

FOREIGN PATENT DOCUMENTS 966519 4/1975 Canada ..... 271/310

*Primary Examiner*—A. T. Grimley
*Assistant Examiner*—P. Stanzione
*Attorney, Agent, or Firm*—Cooper & Dunham

[57] ABSTRACT

An electrophotographic image forming apparatus includes a suction transport unit which is provided in the upper housing portion and which sucks paper on a paper transport path and transports the paper along the paper transport path. The suction transport unit has a paper transport surface on which the paper is transported in a state where the paper is sucked. The apparatus also includes a supporting mechanism which flexibly supports the suction transport unit to an upper housing portion of the apparatus, which is rotatably supported to a lower housing portion thereof. A first group of projections projects downward from the suction transport unit, and a second group of projections project upward from the lower housing portion. When the upper housing portion is closed, the first group of projections come into contact with the second group of projections so that the paper transport surface of the suction transport unit is positioned with respect to the paper transport path by the first and second groups of projections.

12 Claims, 2 Drawing Sheets

ELECTROPHOTOGRAPHIC IMAGE FORMING APPARATUS

BACKGROUND OF THE INVENTION

The present invention generally relates to an electrophotographic image forming apparatus, such as a copying machine, a facsimile machine or a laser beam printer.

There is known a laser beam printer which has a paper transport path on which paper is transported toward an upper circumferential portion of a photosensitive drum. The laser beam printer has a rotatable upper housing portion and a stationary lower housing portion. The paper transport path is located at a boundary between the upper and lower housing portions of the laser beam printer. The rotatable upper position is rotatably supported at an end portion of the stationary lower housing portion. The rotatable upper housing portion includes a suction transport unit, which sucks paper by a negative pressure and transports the same.

An image formed on the photosensitive drum is transferred to a downward surface of the paper. Thus, it is possible to eject sheets of paper in order of page to a paper eject tray. It is also possible to prevent toner particles which are not fixed on the photosensitive drum from falling to paper and being contaminated. When the rotatable upper housing portion of the laser beam printer is opened, the paper transport path is exposed. Thus, it is possible to remove jammed paper on the paper transport path. Further, since paper is transported by the suction transport unit so that it is maintained on an upper side of the paper transport path in the sucked state, it is possible to prevent paper from hanging down. If paper hangs down, a leading end of the paper is not inserted into a nip portion of a fixing roller so that paper is jammed. Further, there is also a possibility that a friction is caused between a trailing end of the paper and the photosensitive drum so that an image on the photosensitive drum which has not yet been transferred to paper is damaged.

However, the above-mentioned laser beam printer has disadvantages described below. An error in positioning the paper transport surface of the suction transport unit with respect to the paper transport path is liable to occur in the state where the rotatable upper housing portion is closed so that it is completely in contact with the stationary lower housing portion. This is caused by a play which occurs between the upper and lower housing portions of the laser beam printer by an abrasion of a fixing member which rotatably fixes the rotatable upper housing portion to the stationary lower housing portion and/or a looseness thereof. The positioning error of the paper transport surface of the suction transport unit with respect to the paper transport path prevents paper from being smoothly transported and causes a deterioration of transferred images and paper jam.

SUMMARY OF THE INVENTION

It is a general object of the present invention to provide an improved electrophotographic image transfer apparatus in which the above-mentioned disadvantages are eliminated.

A more specific object of the present invention is to provide an electrophotographic image transfer apparatus in which the paper transport surface of the suction transport unit is precisely positioned with respect to the paper transport path.

The above-mentioned objects of the present invention are achieved by an electrophotographic image forming apparatus comprising:

an upper housing portion;

a lower housing portion, the upper housing portion being rotatably supported to the lower housing portion around an end portion of the lower housing portion;

paper feed means for feeding a sheet of paper;

a paper transport path having a first end coupled to the paper feed means and a second end opposite to the first end;

image recording means, provided in the lower housing portion, for recording an image on the paper on the paper transport path;

suction transport means, provided in the upper housing portion, for sucking the paper on the paper transport path and transporting the paper along the paper transport path, the suction transport means having a paper transport surface on which the paper is transported in a state where the paper is sucked;

paper eject means, coupled to the second end of the paper transport path, for ejecting the paper on the paper transport path;

supporting means for flexibly supporting the suction transport means to the upper housing portion;

a first group of projections projecting downward from the suction transport unit; and a second group of projection projecting upward from the lower housing portion;

wherein when the upper housing portion is closed, the first group of projections come into contact with the second group of projection so that the paper transport surface of the suction transport means is positioned with respect to the paper transport path by the first and second groups of projections.

BRIEF DESCRIPTION OF THE DRAWINGS

Other objects, features and advantages of the present invention will become apparent from the following detailed description when read in conjunction with the accompanying drawings, in which.

DESCRIPTION OF THE PREFERRED EMBODIMENTS

A description will now be given of an electrophotographic image forming system according to a preferred embodiment of the preset invention.

Figure 1:
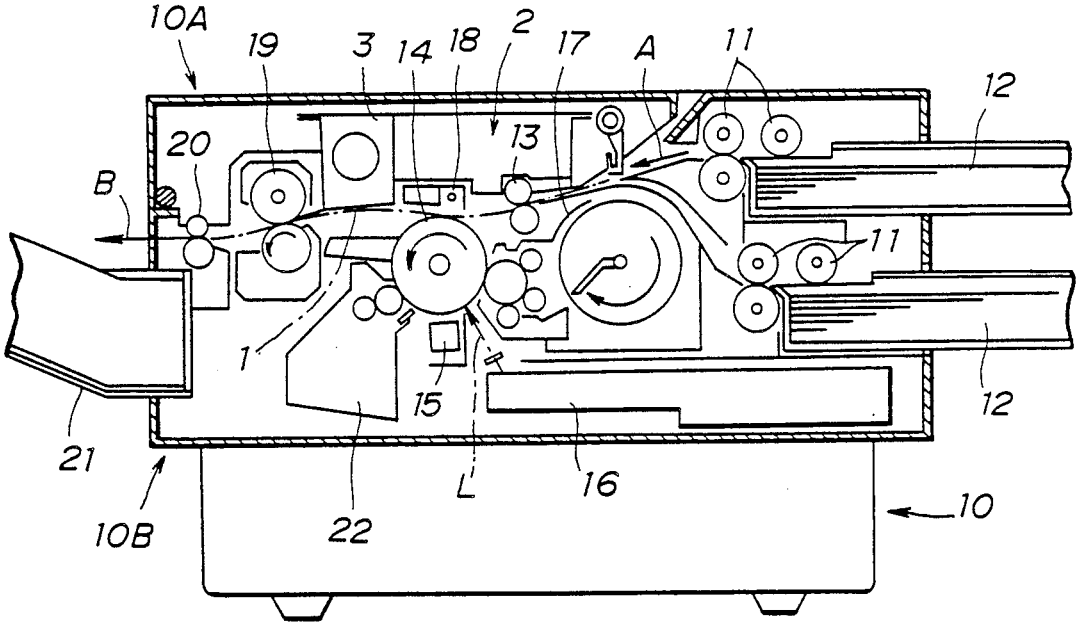
FIG. 1 is a diagram of a laser beam printer according to a preferred embodiment of the present invention.

Referring to FIG. 1, there is illustrated a laser beam printer according to a preferred embodiment of the present invention. Two paper feed cassettes having sheets of paper 12 are detachably attached to a laser beam printer main frame 10. Paper is transported in the direction indicated by arrow A by a paper feed mechanism 11, which is provided for each of the paper feed cassettes. A pair of registration rollers 13 defines a timing at which paper is fed to a photosensitive drum (electrostatic latent image carrier) 14. The photosensitive drum 14 is rotated in the counterclockwise direction, as shown by the arrow. During rotation, a circumferential surface of the photosensitive drum 14 is charged by a corona charger 15 and a laser beam L emitted from a laser optical system 16 is projected onto the circumferential surface so that an electrostatic latent image is formed thereon. The electrostatic latent image is converted into a visual image through a developer unit 17, which supplies the photosensitive drum 14 with toner particles. The visual image is transferred, through a transfer/detach charger 18, to the paper 12 which is in contact with an upper housing portion of the photosensitive drum 14. The paper 12 is electrostatically detached from the photosensitive drum 14, and is then transported to a fixing device 19. Then the visual image on the paper 12 is fixed. After that, the paper is transported toward a paper eject cassette 21 by a pair of paper eject rollers 19, as indicated by the arrow shown in FIG. 1. On the other hand, toner particles left on the photosensitive drum 14 are removed by a cleaning blade and then retrieved to a cleaning device 22.

Figure 2:
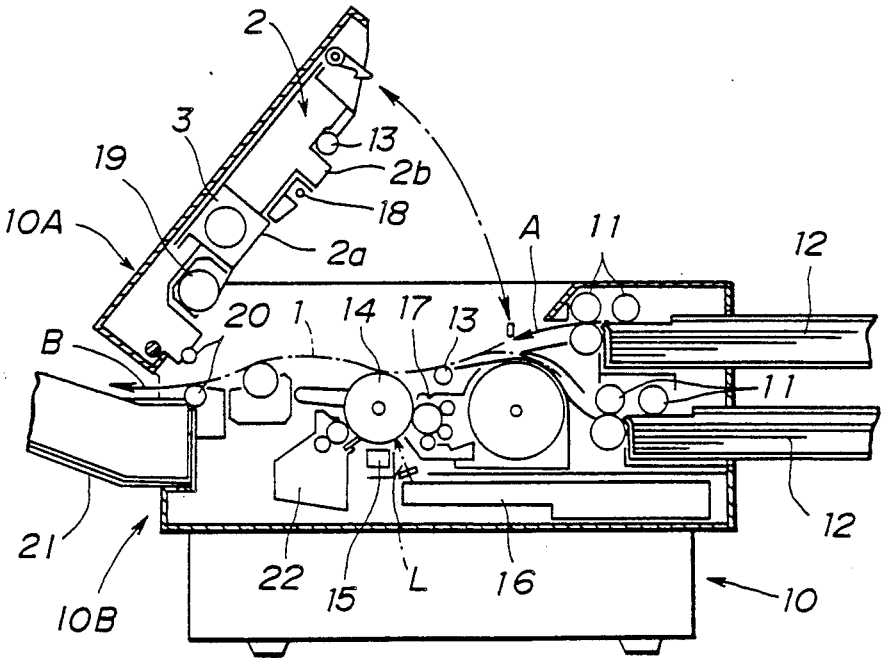
FIG. 2 is a block diagram of the laser beam printer shown in FIG. 1 in a state where an upper housing portion is opened.
Figure 3:
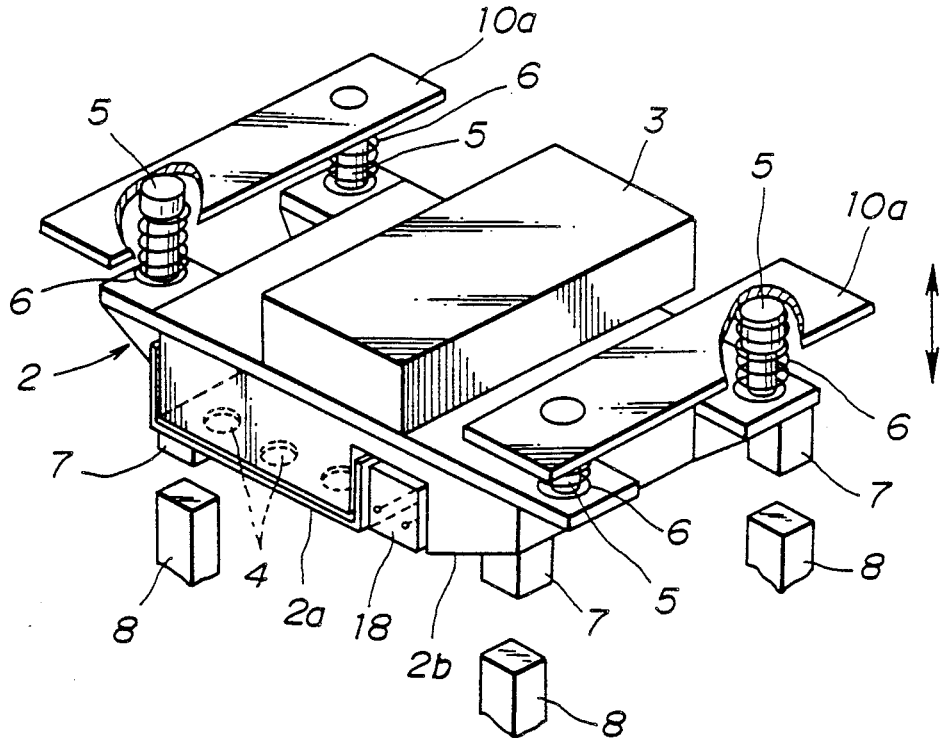
FIG. 3 is a perspective view of a suction transport unit provided in the laser beam printer shown in FIGS. 1 and 2.
Figure 4:
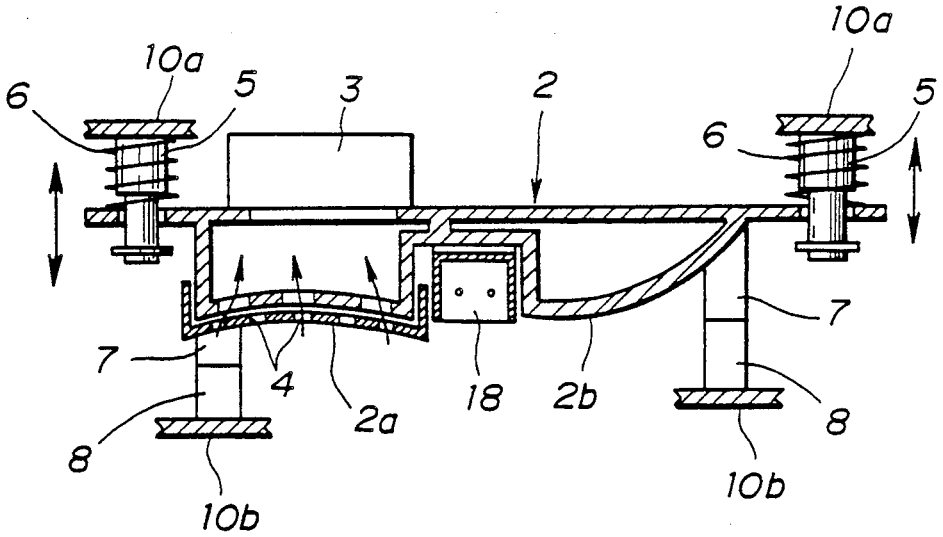
FIG. 4 is a cross sectional view of the suction transport unit shown in FIG. 3.

A paper transport path 1 (illustrated by a one-dotted chain line in FIG. 1) is formed so that the paper 12 is transported toward the upper housing portion of the photosensitive drum 14. As shown in FIG. 2, an upper housing portion 10A of the laser beam printer is rotatably fastened to a lower housing portion 10B thereof. A part of the paper transport path 1 between the registration rollers 13 and the fixing unit 19 is defined by paper transport surfaces 2*a* and 2*b* which are lower surfaces of a suction transport unit 2 arranged in the upper housing portion 10A, as shown in FIGS. 2 through 4.

The suction transport unit 2 has a box in which a suction fan 3 is provided. A large number of suction openings is formed in the paper transport surface 2*a* which defines the portion of the paper transport path 1 between the photosensitive drum 14 and the fixing unit 19. A negative pressure is generated by the suction fan 3 which is rotating. The negative pressure sucks air through the suction openings 4. Thereby, the paper is held in contact with the paper transport surface 2*a*. A transport force exerted on the paper 12 is generated by the rotation of the registration rollers 13 and the fixing unit 19. In a case where the length, of the paper transport path 1 is greater than that of the paper 12, a belt transport mechanism may be provided in which a belt is moved along the paper transport surfaces 2*a* and 2*b* of the suction transport unit 2. The paper transport surface 2*a* is slightly curved so that it is a concave surface which faces the paper transport path 1. The paper 12 is brought in contact with the slightly concave paper transport surface 2*a* due to the function of stiffness of paper (quality of paper).

The suction transport unit 2 has supporting shafts 5 fixed to frames 10*a* of the upper housing portion 10A and springs 6 wound around the supporting shafts 5. With these structural parts, the suction transport unit 2 is supported flexibly with respect to the paper transport path 1 (in the direction substantially perpendicular to the paper transport path 1). Four unit support members 7 are mounted on the paper transport surface 2*a* outside of the paper transport path 1 and project downward. On the other hand, support members 8 fixed to the frame 10*b* of the lower housing portion 10B of the laser beam printer are provided so that they are located at positions opposite to the unit support members 7 and project upward. Each of the supporting shafts 5 has a first end which is fixed to the frame 10*a* of the upper housing portion 10A and a second end which is attached to a plate-shaped frame of the suction transport unit 2 so that it projects therefrom downward. Each of the coil springs 5 has a first end which is fixed to the frame 10*a* and a second end which is fixed to the plate-shaped frame of the suction transport unit 2. The unit support members 7 and the support members 8 come in contact with each other in the state where the upper housing portion 10A is closed and mounted on the lower housing portion 10B. In this state, the suction transport unit 2 is pushed up against the elastic force of the springs 6. The unit support members 7 and the support members 8 have shapes and dimensions so that the paper transport surfaces 2*a* and 2*b* of the suction transport unit 2 are located at appropriate positions with respect to the paper transport path 1 in the state where the unit support members 7 are in contact with the support members 8. Thus, it is possible to precisely define a gap (space) in the direction in which the upper housing portion 10A is opened. For example, it is possible to precisely define a gap between the transfer/-detach charger 18 provided in the suction transport unit 2 and the circumferential surface of the photosensitive drum.

Alternatively, it is possible to use leaf springs in place of the supporting shafts 5 and the springs 6.

The present invention is not limited to the specifically described embodiment, and variations and modifications may be made without departing from the scope of the invention.

What is claimed is:

1. An electrophotographic image forming apparatus comprising:

an upper housing portion;

a lower housing portion, said upper housing portion being rotatably supported to said lower housing portion around an end portion of said lower housing portion:

paper feed means for feeding a sheet of paper;

a paper transport path having a first end coupled to said paper feed means and a second end opposite to said first end;

image recording means, provided in said lower housing portion, for recording an image on said paper on said paper transport path;

suction transport means, provided in said upper housing portion, for sucking said paper on said paper transport path and transporting said paper along said paper transport path, said suction transport means having a paper transport surface on which said paper is transported in a state where said paper is sucked;

paper eject means, coupled to the second end of said paper transport path, for ejecting said paper on said paper transport path;

supporting means for flexibly supporting said suction transport means to said upper housing portion;

a first group of projections projecting downward from said suction transport unit; and a second group of projections projecting upward from said lower housing portion;

wherein when said upper housing portion is closed, said first group of projections come into contact with said second group of projection so that said paper transport surface of said suction transport means is positioned with respect to said paper transport path by said first and second groups of projections.

2. An electrophotographic image forming apparatus as claimed in claim 1, wherein said supporting means comprises spring means provided between said suction transport means and said upper housing portion so that said suction transport means is movable in a direction substantially perpendicular to said paper transport path.

3. An electrophotographic image forming apparatus as claimed in claim 2, wherein said spring means comprises a plurality of shafts provided between said suction transport means and said upper housing portion and springs wound around said shafts.

4. An electrophotographic image forming apparatus as claimed in claim 3, wherein said springs are coil springs.

5. An electrophotographic image forming apparatus as claimed in claim 3, wherein said shafts have first ends which are fixed to said upper housing portion and second ends which are attached to said suction transport means so that said second ends are movable in a direction substantially perpendicular to said paper transport path.

6. An electrophotographic image forming apparatus as claimed in claim 5, wherein said springs have first ends which are fixed to said upper housing portion and second ends which are fixed to said such transport means.

7. An electrophotographic image forming apparatus as claimed in claim 1, wherein said first group of projections is located at portions on said paper transport surface outside of said paper transport path.

8. An electrophotographic image forming apparatus as claimed in claim 1, wherein said paper transport surface is a concave surface which faces said paper transport surface.

9. An electrophotographic image forming apparatus as claimed in claim 1, wherein said paper transport surface has a plurality of openings.

10. An electrophotographic image forming apparatus as claimed in claim 9, wherein said suction transport means comprises a fan which sucks air from said plurality of openings.

11. An electrophotographic image forming apparatus as claimed in claim 1, wherein said electrophotographic image forming apparatus is a laser beam printer.

12. An electrophotographic image forming apparatus as claimed in claim 1, wherein:

said paper feed means are detachably attached to said lower housing portion; and said paper eject means are detachably attached to said lower portion.

* * * * *